United States Patent [19]

Fletcher et al.

[11] 4,270,475

[45] Jun. 2, 1981

[54] METHOD OF FORMING A FLUSH-SIDED CONTAINER

[75] Inventors: Wade D. Fletcher; Edward H. McMahon; Dwight D. Grady, all of Hartsville, S.C.

[73] Assignee: Sonoco Products Company, Hartsville, S.C.

[21] Appl. No.: 58,747

[22] Filed: Jul. 19, 1979

[51] Int. Cl.[3] ..... B21D 51/00

[52] U.S. Cl. ..... 113/120 K; 113/120 XY; 113/121 R; 220/75; 229/56

[58] Field of Search .... 113/116 QA, 120 K, 120 XY, 113/120 Y, 120 AA, 121 R, 121 AB, 121 C; 229/5.5, 5.6; 220/67, 75, 77

[56] References Cited

U.S. PATENT DOCUMENTS

| | | | |
|---|---|---|---|
| 2,343,550 | 3/1944 | Grove | 113/120 XY UX |
| 2,641,827 | 6/1953 | Carpenter | 113/120 XY X |
| 2,643,627 | 6/1953 | Wobbe | 113/120 X |
| 2,849,148 | 8/1958 | Lohuis | 220/67 |

FOREIGN PATENT DOCUMENTS

| | | | |
|---|---|---|---|
| 1175596 | 8/1964 | Fed. Rep. of Germany | 229/5.6 |

*Primary Examiner*—Howard N. Goldberg
*Attorney, Agent, or Firm*—Dennison, Meserole, Pollack & Scheiner

[57] ABSTRACT

A system of seaming a metallic end cover to a tubular composite can body utilizing a cover the diametric size of which is smaller than that of the can body. The smaller cover provides an annular space between the central depending cover pin and the surrounding portion of the body wall at the end thereof. The peripheral flange of the cover is inwardly folded about and with the flanged end of the can body to define a double seam. Simultaneously with the formation of the double seam, the seaming rolls, through direct engagement with the can body at and immediately below the seam, inwardly shape and contour the end portion of the can body, bringing the formed seam into the annular space and into direct engagement with the cover pin, necking the can body and providing a flush-sided container.

6 Claims, 19 Drawing Figures

34
26
22
28

38
32
28
22

38
26
22
34
40

38
22
40

24
22
34

34
22

38
28
22

38
22
34
40

38
22
34
40

24
22
34

METHOD OF FORMING A FLUSH-SIDED CONTAINER

BACKGROUND OF THE INVENTION

The present invention is concerned with the provision of a composite container which constitutes a viable alternate to the conventional metal can now finding particular use in the beverage industry for non-carbonated or lightly carbonated soft drinks.

The beverage industry has converted almost entirely to necked metal cans which enable the use of smaller diameter end covers on the can bodies; for example, the use of a 209 (2 and 9/16 inch) cover on a 211 (2 and 11/16 inch) metal can body. Such an arrangement provides both certain economies and particular advantages. The use of the smaller size cover is obviously less expensive. The inward necking of the body prior to the application of the cover enables the formation of a flush-sided container which is more easily and compactly packaged, reduces chime damage, facilitates the application of plastic six-pack retainers, etc.

In proposing the use of composite can bodies as an alternative to the conventional aluminum or other types of metallic can bodies, it is essential that the necked configuration be maintained in order to retain the particular advantages associated therewith, including the use of smaller, less expensive, covers and the ability to provide flush-sided containers, while at the same time acquiring the particular advantages of a composite can body including decreased costs, increased insulation, and, in some instances, increased strength.

In attempting to arrive at a satisfactory composite body substitute for the conventional metal or aluminum body, it was proposed initially that the end portion of the composite body be pre-necked, as is the procedure with the metal bodies. However, not only is this a time consuming step, but also it has been found difficult to achieve a proper and consistent necking of the bodies, due to the nature of the composite material. In addition, the pre-necking of composite tubular bodies appears to have an undesirable effect on the structural integrity of the composite body. Such a pre-necking of a composite can body will be noted in FIGS. 8 through 12 of U.S. Pat. No. 2,343,550 to Grove, and is also suggested in FIG. 12 of U.S. Pat. No. 2,641,827 to Carpenter. Carpenter, at FIG. 11, illustrates a flush-sided construction wherein the rolled portion of the cover flange and engaged portion of the body wall are crushed against the disc-backed collar portion 27 snugly received within the upper end portion of the body prior to a formation of the seam. Such a crushing of the seam, including the engaged portion of the composite container, will do substantial damage to the integrity of the juncture of body and cover.

SUMMARY OF THE INVENTION

The present invention proposes a system for providing a flush-sided container incorporating a composite tubular body and a metal end cover which, while not limited thereto, is particularly adapted for the accommodation of non-carbonated or slightly carbonated beverages. In providing such a container, it is proposed that a double seam be formed within a necked end portion of the can body without pre-necking the body and without excessively crushing or otherwise adversely affecting the structural integrity of the seam and adjacent body portions.

Basically, it is proposed that a smaller cover, for example a 209 cover, be introduced into the end portion of a relatively larger can body, for example a 211 body, which, while outwardly flared or flanged in a conventional manner, has not been pre-necked. In positioning the cover, the pin thereof, i.e., that cup-like depressed central portion which constitutes the major portion of the cover, is freely received within the end portion of the body in a manner whereby an annular space is defined completely thereabout. This space, when using a 209 cover within a 211 body, will have an average width of approximately one-sixteenth inch, which in turn generally approximates the thickness of the body wall. A seaming chuck is snugly received within the cup-shaped portion of the cover defining the pin to provide a stabilizing back-up during the seaming operation. Next, the peripheral outwardly projecting flange of the cover, which overlies the can body flange, is subjected to a series of seaming rollers which downwardly and inwardly roll the cover flange into intimate engagement witn the can body flange with the continued rolling action effecting a folding of both flanges together so as to define a double seam. As this is occurring, and because of the annular space between the body wall and the centrally positioned cover pin, the end portion of the body is simultaneously inwardly necked into intimate engagement with the chuck backed pin. The resultant product is a double seamed flush-sided composite container which has been produced during the simultaneous seaming and necking operation without necessitating a separate pre-necking step.

In achieving the necking of the body, simultaneously with the seaming operation, it is contemplated that the seaming rolls be specifically configured to engage the can body immediately below the seam as it is being formed whereby direct inward shaping and necking pressure is applied to the container body. Further, the seaming rolls are configured to provide a smoothly rounded shoulder transition area between the neck and the full diameter body of the can. While not specifically limited thereto, it is preferred that the neck be only sufficient to accommodate the double seam, thus maintaining a maximum degree of stacking strength in the finished container. It is of interest to note that the technique proposed herein provides a substantial increase in the structural integrity of a composite container over a composite container formed with a pre-necking step.

A particularly important feature of the above procedure, using a 209 cover on a 211 body, and a feature which makes the invention practical from a commercial standpoint, is the ability of the cans to run in already operational conventional can lines, to carry out the above combined seaming and necking operations, with only minimum changeover time. As an example, the high speed can closers or seamers manufactured by Angelus Sanitary Can Machinery Company, the machines now most commonly in use for the closing of metal juice, soft drink, and the like cans, can be completely converted in approximately one half hours time to accept and simultaneously seam-close and neck unnecked composite cans in the above described manner and at the rated speed of the particular equipment normally encountered when using metal cans. The ability of the seaming equipment to be readily converted for the selective accommodation of pre-necked metal cans and unnecked composite cans greatly enhances the capacity of the seaming equipment, an added advantage derived from the procedure by which the flush-sided double seam composite container is formed.

In forming the rolled double seam, both the cover flange and the body flange are rolled downward and inward whereby the outer flap of the body end is completely encircled by the folded cover flange and positioned parallel to and intimately against the adjoining inner portion of the body wall. The annular space, which specifically accommodates the necking of the body end portion during the seaming operation, enables a complete formation of the seam and simultaneous necking of the can body in a manner providing for an intimate seal without excess crushing either the composite material of the body or the flange of the metal cover. If so desired, and in order to enhance the seal, an appropriate adhesive or sealant can be applied to the facing portions of the cover and/or body prior to the formation of the seam.

While reference is made to a flush-sided seam, it is to be understood that various manufacturing tolerances may result in a seam the outer face of which is either slightly recessed relative to the can body or slightly projected therebeyond. However, the inward necking of the body during the seaming operation provides significant recession of the formed double seam and, for all practical purposes, a substantially flush-sided container.

The term composite can, as used herein, primarily refers to tubular bodies formed of multiple layers of adhesively bonded spirally wound paperboard or the like. These bodies will normally include inner, and possibly outer, layers of metallic foil or plastic membrane material. Also, under some circumstances, it may be desired to use formable plastic bodies, resin impregnated plys, or combinations of both.

Additional specific objects and advantages, residing in the details of construction and operation, will become apparent as the invention is more fully hereinafter described and claimed.

DESCRIPTION OF PREFERRED EMBODIMENT

Figures 1, 2, 3, 4, 5, 6, 7, 8, 9:
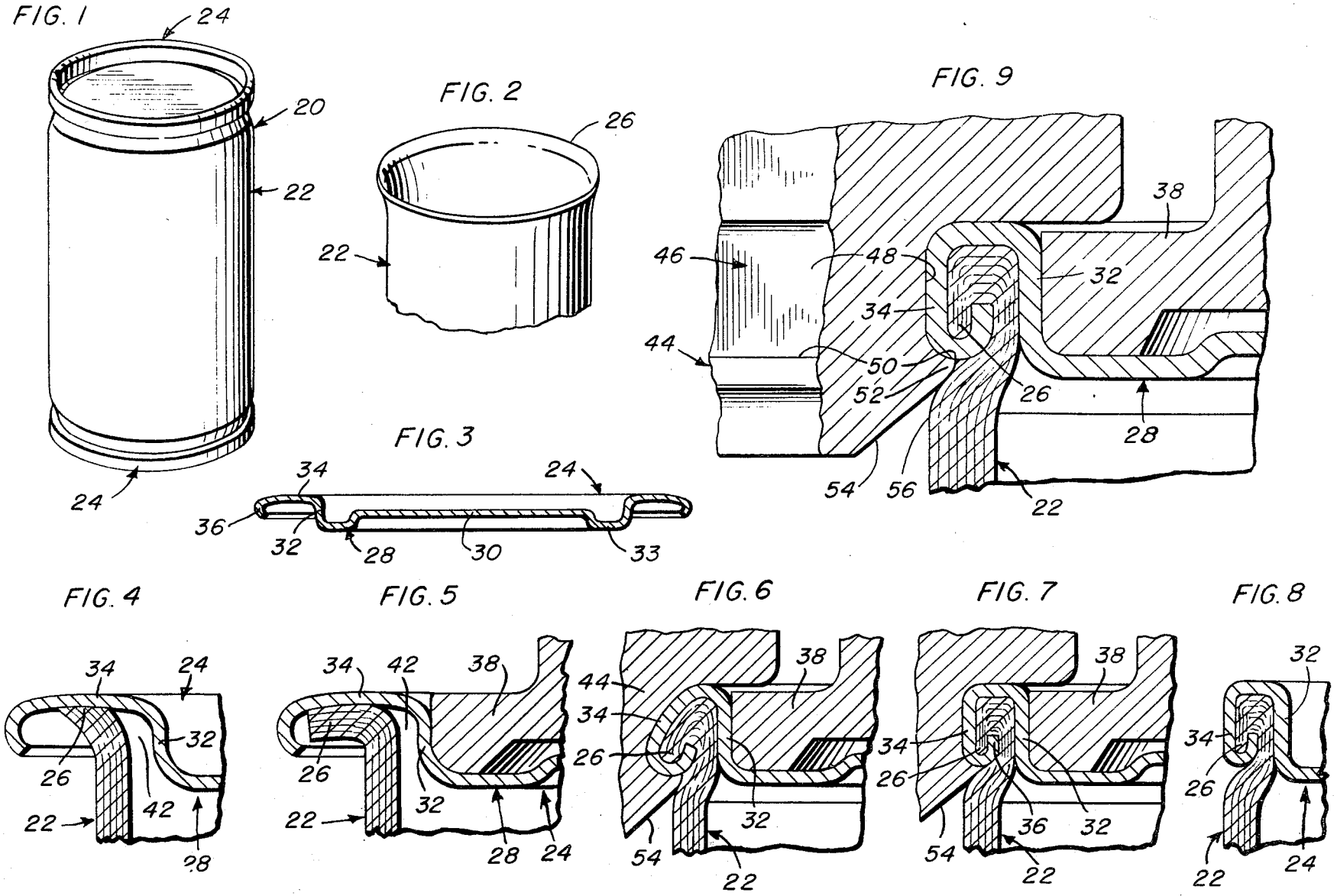
FIG. 1 is a perspective view of a composite container constructed in accordance with the present invention.
FIG. 2 is a perspective view of the flared upper end of a composite can prior to the application of the metal cover thereto.
FIG. 3 is an enlarged cross-sectional view through a metal cover to be applied in accordance with the present invention.
FIG. 4 is a cross-sectional detail illustrating the initial disposition of a smaller diameter cover on the flanged end of a larger diameter composite can body.
FIG. 5 is a cross-sectional detail illustrating the subsequent introduction of the seaming chuck into the cover pin with the pressure thereof bringing the cover flange and can flange into intimate engagement and causing a deflection of the container flange.
FIGS. 6 and 7 illustrate the sequential use of seaming rolls to effect both double seaming and simultaneous inward necking of the can body.
FIG. 8 is a sectional detail through the formed flush-sided container with the recessed double seam.
FIG. 9 is an enlarged cross-sectional view, similar to FIG. 7, illustrating details of a seaming roll.
Figures 10, 11, 12, 13, 14, 15, 16, 17, 18, 19:
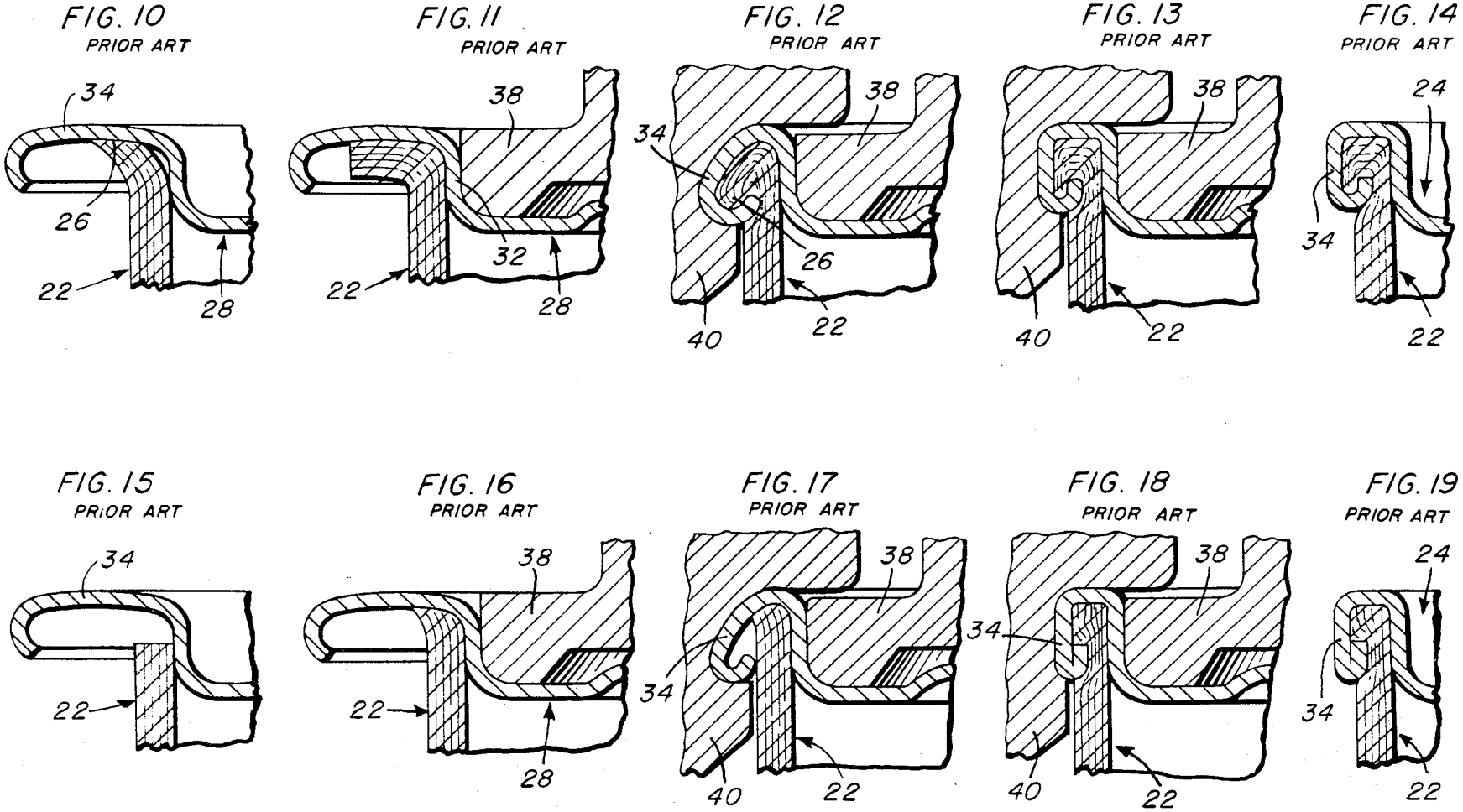
FIG. 10 PRIOR ART
FIG. 11 PRIOR ART
FIG. 12 PRIOR ART
FIG. 13 PRIOR ART
FIG. 14 PRIOR ART
FIG. 15 PRIOR ART
FIG. 16 PRIOR ART
FIG. 17 PRIOR ART
FIG. 18 PRIOR ART
FIG. 19 PRIOR ART
FIGS. 10 through 14 illustrate a sequence of steps in forming a conventional double seam.
FIGS. 15 through 19 illustrate a sequence of steps in the forming of a conventional false seam.

Referring now more specifically to the drawings, reference numeral 20 is used to designate an end closed composite can or container in accordance with the present invention. The can 20 includes a tubular composite can body 22 having metallic end covers 24 seamed to the opposite ends thereof.

The composite can body 22 normally will be formed of multiple spirally wound plys of paper stock with an inner impervious foil or plastic liner. As an initial step, the end of the body 22, which is to receive an end cover or cap 24 in a manner pursuant to the present invention, is outwardly flanged or flared as at 26.

The metal end cover 24 includes a cup shaped depressed cylindrical portion 28. This portion is commonly referred to as a pin and includes a disc-like base 30 surrounded by an annular wall 32 projecting substantially perpendicularly upward from the base 30. The base 30 will normally incorporate a rigidifying ridge 33 defined therein and, if considered appropriate, a tab opener. The cover is completed by an annular flange 34 integrally formed with the upper edge of the pin wall 32 and projecting peripherally outward therefrom to an outer downwardly and slightly inwardly curled edge 36.

The cover 24 can be seamed to the tubular composite can body 22 in a conventional manner, for example as suggested in FIGS. 10 through 14. With such an arrangement, the cover and body are of the same size, for example a 211 diameter cover on a 211 diameter body. The outside diameter of the pin 28 is substantially the same as the internal diameter of the body 22 with the pin 28 being frictionally received within the corresponding end portion of the body 22 to a depth sufficient to engage the cover flange 34 with the flared or flanged end 26 of the body 22. This conventional relationship will be noted in FIG. 10 and is followed by the introduction of a seaming chuck 38 into the pin 28, through the open upper end thereof, and into peripheral engagement with the pin wall 32 so as to provide a rigidifying backing therefore during the seaming operation. Finally, a series of seaming rolls 40 engage the cover flange 34 and cause a progressive inward rolling of the flange in conjunction with a doubling over or folding of the body flanged end 26 to arrive at the double seam depicted in FIG. 14. While such a seam normally provides a projecting chime, the seam can be formed flush with the outer side of the can body by pre-necking the end of the container body and forming of the double seam in the pre-neck portion utilizing a relatively smaller cover having the pin thereof snugly received within the pre-neck portion. Such an arrangement is generally suggested in U.S. Pat. No. 2,343,550 to Grove.

A known modification of the above described double seam is referred to as a false seam. Such a seam, and the manner of forming associated therewith, are illustrated in FIGS. 15 through 19. Basically, the flanged or flared end is eliminated from the can body whereby the inwardly rolled cover flange 34 rolls on itself and engages against the outer surface of the can body without actually rolling or folding the end portion of the can body. Such a seam, while giving the appearance of the previously described double seam, is of a weaker and less desirable construction. In forming the false seam, it will be appreciated that the pin is snuggly received within the end portion of the can body with the seaming chuck 38 similarly closely received within the pin 28 so as to provide a back-up surface during the rolling or seaming operation.

Should it be desired to provide a flush-sided can incorporating a false seam, the end portion of the tubular body, in accordance with the teaching in the prior art, can be pre-necked and the seam formed within the pre-necked portion utilizing a smaller cover having a pin thereon capable of snug reception within the pre-necked portion.

By pre-necking the can body prior to seaming the cover thereto, it is possible to achieve a flush-sided container while retaining the integrity of the cover and can interlock. The present invention proposes a unique system for forming a flush-sided composite container with a seam of maximum integrity without the separate step of pre-necking the can body. The system of the present invention will be best appreciated from FIGS. 4 through 8 of the drawings.

Basically, the end cover 24, used in the system of the present invention, is of a smaller diametric size than the diametric size of the can body 22. For example, in forming a popular size container for use in the beverage industry, a 209 diameter cover will be used in conjunction with a 211 diameter body. Such a combination will result in the provision of a distinct and substantial space or clearance 42 between the surrounding wall 32 of the pin 28 and the inner surface of the can body 22 peripherally about the pin. This clearance, in the given example, will be approximately one-sixteenth inch and is generally equal to the thickness of the wall of the can body. It will be noted that the width of the cover flange 34 is sufficient to completely overlie and project outwardly beyond the flanged end 26 of the can body 22.

After positioning the cover 24 on the can body 22, the seaming chuck 38 is introduced into the pin 28 of the cover 24 with the seaming chuck engaging the inner surface of the circular wall 32, providing a rigid support or back-up means during the seaming operation.

Subsequent to positioning the seaming chuck 38, a series of seaming rolls 44 are sequentially engaged with the curved outer periphery of the cover flange 34 to effect a seaming or inward rolling thereof, in conjunction with the underlying flanged portion 26 of the can body 22, to simultaneously form a double seam and effect an inward displacement of the container body end portion, as will be readily appreciated from FIGS. 6 and 7. This seaming action ultimately results in a flush-sided double seam as shown in FIG. 8. This has been achieved without pre-necking of the can body, thus avoiding a time consuming, relatively expensive, and potentially can damaging step.

Of particular significance with regard to the necking of the can body in conjunction with the formation of the double seam is the configuration of the seaming rolls 44. In connection therewith, attention is directed to FIG. 9 wherein the second stage seaming roll of FIG. 7 has been presented in greater detail. This roll 44 includes an annular seam forming recess 46 defined by the seam forming wall 48 which in turn terminates in a lower annular edge 50, providing a recess depth equal to or very slightly greater than the thickness of the cover flange 34.

The portion 52 of the roll 44 immediately below the recess 46 includes an outer body shaping wall 54 specifically configured to engage and inwardly shape the can body by direct engagement therewith immediately below the double seam as it is being formed. This engagement of the body shaping wall 54 with the can body is continuous outward from the inwardly offset lower peripheral edge of the folded flange 34 to the outer periphery of the can body, and forms a smoothly rounded shoulder 56, immediately below the seam, which provides a necked configuration on the end of the can body with substantially no crushing of the can material and little if any deleterious affect on the structural integrity of the can.

As will be appreciated from FIG. 6, the other seaming rolls in the sequence of rollers are also specifically configured to include the body shaping wall 54 configured to engage the can body, at the lower edge of the seam and immediately therebelow, during each stage of the seam forming operation to directly configure or inwardly neck the can body as the seaming operation progresses. In each instance, the wall 54 directly engages the wall of the body 22 continuously downward from the seam forming flange to provide for a direct application of force thereto within the angular recess provided below the rolled cover flange in a manner to define the desired smoothly rounded shoulder constituting the lower end of the neck.

It is preferred that there be no appreciable necking of the can body 22 below the double seam for purposes of maintaining crush strength. In other words, by keeping the height of the neck to a minimum, loads introduced to the can covers, for example in stacking, are directly transferred to the wall of the can body 22. Were an elongated neck provided below the formed seam, a major portion of the loading force would be taken by the formed shoulder portion, and thus reduce the crush capability of the container. Nevertheless, in some circumstances a lengthening of the neck may be desired, for example for the accommodation of an overcap.

In summary, the invention herein proposes a unique system for applying and double seaming a smaller diameter cover to a larger diameter can body in a manner so as to shape and neck the can body simultaneously with the formation of the double seam, both to accommodate the preferred smaller cover and to form a flush-sided container. This is achieved basically by the provision of a neck accommodating clearance between the outer periphery of the central cover pin and the inner diameter of the end portion of the can body, in conjunction with a pin stabilizing seaming chuck and sequentially used seaming rolls configured to both seam the cover to the body and inwardly shape the seamed end portion, during the actual seaming sequence, into engagement with the chuck stabilized central pin.

While the above detailed description has been directed primarily to the application of a container cover to one end of a can body, it is to be appreciated that a similar system of double seaming and necking is contemplated in conjunction with both ends of the can body.

The foregoing is considered illustrative of the principles of the invention. Accordingly, it is contemplated that the scope of the invention as claimed encompass all obvious variations, modifications and equivalents which may occur to those skilled in the art.

We claim:

1. A method of seaming a metallic end cover to a tubular composite can body comprising the steps of providing a metallic end cover having a cup shaped projecting central pin of an external diameter sufficiently less than that of the internal diameter of the can body to define an annular space therebetween upon a central positioning of the central pin within one end portion of the can body, said metallic end cover further including an annular outwardly directed flange peripherally about said central pin, positioning said end cover over an end of the can body with the cover flange resting directly on said can body end and with the central pin received within the end portion of the can body in inwardly spaced relation to the surrounding can body, rolling said flange downwardly and inwardly into seam forming engagement with the can body end portion and substantially simultaneously inwardly deforming the formed seam and inwardly necking the end portion of the can body into the defined space and into intimate contact with the central pin of the end cover circumferentially thereabout.

2. The method of claim 1 including outwardly flanging the end of the can body prior to a rolling of the cover flange, and rolling the flanged end of the can body with and within the over flange to form a double seam.

3. The method of claim 2 wherein the formed seam and engaged end portion of the can body are inwardly deformed a distance sufficient to bring the outer periphery of the seam in substantial alignment with the outer surface of the can body.

4. The method of claim 3 wherein said center pin, when received within the end portion of the can body, is centrally positioned relative thereto to define an equal space between the pin and the surrounding can body peripherally about the pin.

5. The method of claim 1 wherein the formed seam and engaged end portion of the can body are inwardly deformed a distance sufficient to bring the outer periphery of the seam in substantial alignment with the outer surface of the can body.

6. In a method of forming a flush-sided double seam can, the steps of providing a can body of a predetermined size with a flush side and, at an end thereof, a peripheral outwardly directed flange, providing a metal cover with a central pin of sufficient lesser diameter than the internal diameter of the can body to define a space therebetween upon a positioning of the pin within the can body, said cover including an outwardly directed flange of greater diameter than the external diameter of the can body flange, positioning said end cover over the flanged end of the can body with the cover flange resting directly on the can body flange and with the central pin received within the end of the can body in inwardly spaced relation to the surrounding body wall, rolling the overlying flanges downwardly and inwardly into seam forming engagement with the can body, and simultaneously inwardly necking the can body into the defined space and into intimate and sealing engagement with the central pin peripherally thereabout.

* * * * *

UNITED STATES PATENT AND TRADEMARK OFFICE

CERTIFICATE OF CORRECTION

PATENT NO. : 4,270,475

DATED : June 2, 1981

INVENTOR(S) : Wade D. Fletcher; Edward H. McMahon; Dwight D. Grady

It is certified that error appears in the above-identified patent and that said Letters Patent are hereby corrected as shown below:

Column 7, line 21, change "over" to --cover--.

Signed and Sealed this

*Fourth* Day of *August 1981*

[SEAL]

*Attest:*

GERALD J. MOSSINGHOFF

*Attesting Officer*

*Commissioner of Patents and Trademarks*